US009241591B2

(12) United States Patent
Messick, Jr.

(10) Patent No.: US 9,241,591 B2
(45) Date of Patent: Jan. 26, 2016

(54) HANGER BAR ASSEMBLY FOR ARCHITECTURAL MESH AND THE LIKE

(71) Applicant: CAMBRIDGE INTERNATIONAL, INC., Cambridge, MD (US)

(72) Inventor: George Howard Messick, Jr., E New Market, MD (US)

(73) Assignee: CAMBRIDGE INTERNATIONAL, INC., Cambridge, MD (US)

( * ) Notice: Subject to any disclaimer, the term of this patent is extended or adjusted under 35 U.S.C. 154(b) by 0 days.

(21) Appl. No.: 14/733,145

(22) Filed: Jun. 8, 2015

(65) Prior Publication Data

US 2015/0265087 A1 Sep. 24, 2015

Related U.S. Application Data

(63) Continuation of application No. 11/265,211, filed on Nov. 3, 2005, now Pat. No. 9,049,954.

(60) Provisional application No. 60/624,176, filed on Nov. 3, 2004.

(51) Int. Cl.

| | |
|---|---|
| ***A47H 23/05*** | (2006.01) |
| ***A47H 23/14*** | (2006.01) |
| ***A47H 13/00*** | (2006.01) |

(52) U.S. Cl.

CPC ..... *A47H 23/05* (2013.01); *A47H 13/00* (2013.01); *A47H 23/14* (2013.01)

(58) Field of Classification Search

CPC ..... A47H 13/00; A47H 23/04; A47H 23/05; B21F 27/00

USPC ..... 160/330, 332, 184, DIG. 15; 211/105.1; 256/45; 52/507, 222; 38/102, 91

See application file for complete search history.

(56) References Cited

U.S. PATENT DOCUMENTS

| | | | |
|---|---|---|---|
| 844,571 | A | 2/1907 | Wikander et al. |
| 858,925 | A | 7/1907 | Bergh |
| 868,244 | A | 10/1907 | Backlin |
| 884,222 | A | 4/1908 | Sherman et al. |
| 902,635 | A | 11/1908 | Wowra |
| 1,995,983 | A | 3/1935 | Hesse |
| 2,030,498 | A | 2/1936 | Chmurski |
| 2,136,042 | A | 11/1938 | Cornell et al. |
| 2,172,112 | A | 9/1939 | Sommer |
| 2,605,828 | A | 8/1952 | Lang |
| 2,958,378 | A | 11/1960 | Rubens |
| 3,231,007 | A | 1/1966 | Kerr |
| 3,640,046 | A | 2/1972 | Anderson et al. |
| 3,798,856 | A | 3/1974 | Gloskowski |
| 4,083,156 | A | 4/1978 | Tye |

(Continued)

FOREIGN PATENT DOCUMENTS

WO WO 03/018274 A1 3/2003

*Primary Examiner* — Blair M Johnson

(74) *Attorney, Agent, or Firm* — Buchanan, Ingersoll & Rooney PC

(57) ABSTRACT

An architectural mesh hanging system having a hanger assembly including a hanger tube having a plurality of openings and an architectural mesh panel of predetermined size having an uppermost edge defined by a plurality of loops. The plurality of loops are positioned within the plurality of openings in the hanger tube and a retaining rod is disposed through the plurality of loops within an interior of the hanger tube, thereby preventing the plurality of loops from displacement out of the plurality of opening.

17 Claims, 5 Drawing Sheets

(56) References Cited

U.S. PATENT DOCUMENTS

| | | | |
|---|---|---|---|
| 4,396,041 | A | 8/1983 | Daringer |
| 4,492,364 | A | 1/1985 | Boyanton |
| 4,736,608 | A | 4/1988 | Laws et al. |
| 5,058,846 | A | 10/1991 | Close |
| 5,787,955 | A | 8/1998 | Dargie |
| 5,915,449 | A | 6/1999 | Schwartz |
| 6,041,916 | A | 3/2000 | Daringer et al. |
| 6,176,050 | B1 | 1/2001 | Gower |
| 6,176,471 | B1 | 1/2001 | Naegele et al. |
| 6,269,958 | B1 | 8/2001 | Pollock et al. |
| 6,378,820 | B1 | 4/2002 | Mooney et al. |
| 6,412,540 | B2 | 7/2002 | Hendee |
| 6,793,360 | B2 | 9/2004 | Goslee |
| 6,865,852 | B2 | 3/2005 | Gower |
| 6,886,299 | B2 | 5/2005 | Gower |
| 6,886,701 | B2 | 5/2005 | Hong et al. |
| 8,006,739 | B2 | 8/2011 | Costello |
| 2002/0000301 | A1 | 1/2002 | Rolin |
| 2003/0131543 | A1 | 7/2003 | Hansort |
| 2005/0269466 | A1 | 12/2005 | Conway et al. |
| 2006/0075699 | A1 | 4/2006 | Messick et al. |

HANGER BAR ASSEMBLY FOR ARCHITECTURAL MESH AND THE LIKE

CROSS-REFERENCE TO RELATED APPLICATION

This application claims priority to U.S. Ser. No. 11/265,211, filed Nov. 3, 2005, now U.S. Pat. No. 9,049,954, which claims priority to provisional application U.S. Ser. No. 60/624,176, filed Nov. 3, 2004, the entire contents of which are hereby incorporated by reference.

TECHNICAL FIELD

The present invention is directed to an apparatus for securing architectural mesh and, more particularly, to a hanger bar assembly for the installation of architectural mesh and the like.

BACKGROUND OF THE INVENTION

Architectural metallic meshes are generally used in commercial and business environments to provide elegant wall panels, doors and other surfaces whenever an aesthetic appearance of polish and prestige are of primary importance. Architectural mesh is also an excellent choice for high contact areas, such as the interior walls of elevator cabs, escalator walls, and sales and reception areas, because it is generally scratch, dent and corrosion resistant. As such, architectural metallic mesh maintains a stunning appearance with minimal maintenance.

Woven into panels from brass, stainless steel, copper, and/or other desired metals or alloys, architectural mesh offers a richness of texture, pattern and color that cannot be duplicated by any other material. Architectural mesh can also be polished, finished and combined with different background colors to create a custom look and configuration.

Depending upon the chosen weave, the interstices or apertures between the weft or fill wires and the warp wires may allow light to pass through the architectural mesh. Alternatively, if the weave is tight and the wires are more closely adjacent to one another, the passage of light through the mesh will be selectively prevented. Accordingly, as the requirement for incorporating energy savings into building design increases, and hence the need for architecturally acceptable sun shading or screening, architectural mesh offers a variety of options that can meet the shading needs while still maintaining architectural requirements.

Thus, it would be desirable to provide system for reliably and conveniently applying an architectural mesh product to a building wall, so as to create the desired sun shading without detracting from the aesthetic appearance of the wall.

SUMMARY OF THE INVENTION

These and other objects of the invention are achieved by an architectural mesh hanging system according to the present invention. The hanging system comprises a hanger assembly including a hanger tube having a plurality of openings; an architectural mesh panel having an uppermost edge defined by a plurality of loops, wherein said plurality of loops are positioned within said plurality of openings in said hanger tube; and wherein a retaining rod is disposed through said plurality of loops within an interior of said hanger tube, thereby preventing said plurality of loops from displacement out of said plurality of opening and securing the architectural mesh panel in position.

A further aspect of the present invention is directed to a hanger bar assembly for architectural mesh, the assembly comprising a hanger bar including a hollow tube; means for mounting said hanger bar on a support surface; and means for supporting architectural mesh within said hanger bar. In a preferred embodiment, the mounting means comprises opposing first and second brackets and a bracket support extending therebetween and the means for supporting architectural mesh comprises a plurality of openings in said hanger bar and a retaining rod. More particularly, said plurality of openings include a plurality of oval-shaped slots disposed at an angle relative to a longitudinal axis of said hanger bar.

A still further aspect of the invention is directed to a method of hanging an architectural mesh panel comprising securing a support structure to a support surface; inserting an uppermost edge of the architectural mesh panel through openings in a substantially hollow hanger bar, the uppermost edge comprising a plurality of loops; and inserting a retaining rod through the plurality of loops of the uppermost edge of the architectural mesh panel; whereby the retaining rod retains the uppermost edge of the architectural mesh panel within the hanger bar and the hanger bar obscures the uppermost edge and retaining rod from view.

BRIEF DESCRIPTION OF THE DRAWINGS

These and other objects, features, and advantages of the present invention will become more readily apparent to those skilled in the art upon reading the following detailed description, in conjunction with the appended drawings in which.

DETAILED DESCRIPTION OF THE PREFERRED EMBODIMENT

Figure 1:
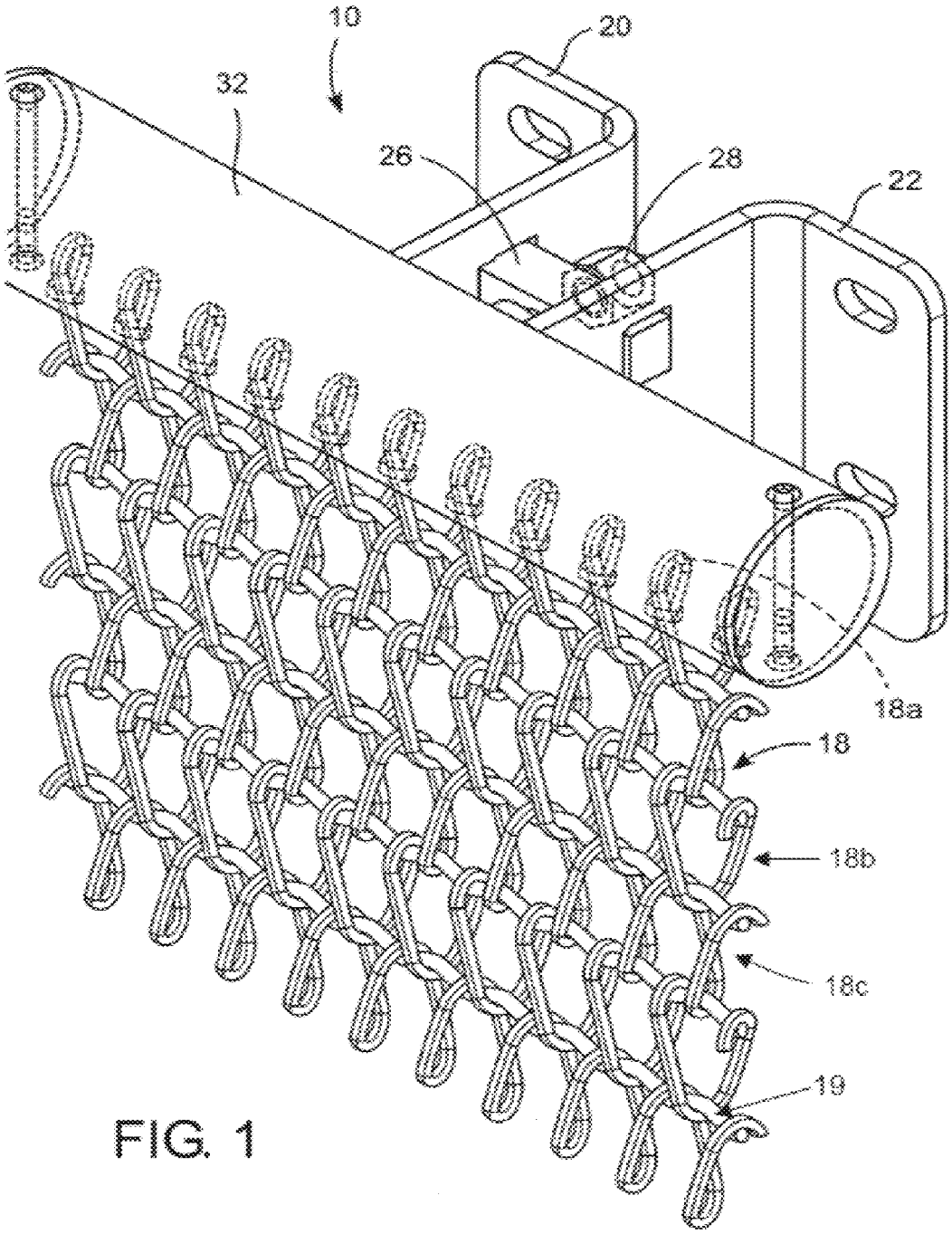
FIG. 1 is a perspective view of the hanger bar assembly of the present invention.

The hanger bar assembly of the present invention is designated generally by reference numeral 10, as shown in FIG. 1. Although a predetermined length hanger bar assembly 10 is illustrated in the drawings, it will be understood by one skilled in the art that depending upon the width of the panel of architectural mesh, the hanger bar assembly will extend generally along the entire width of said panel.

Figure 2:
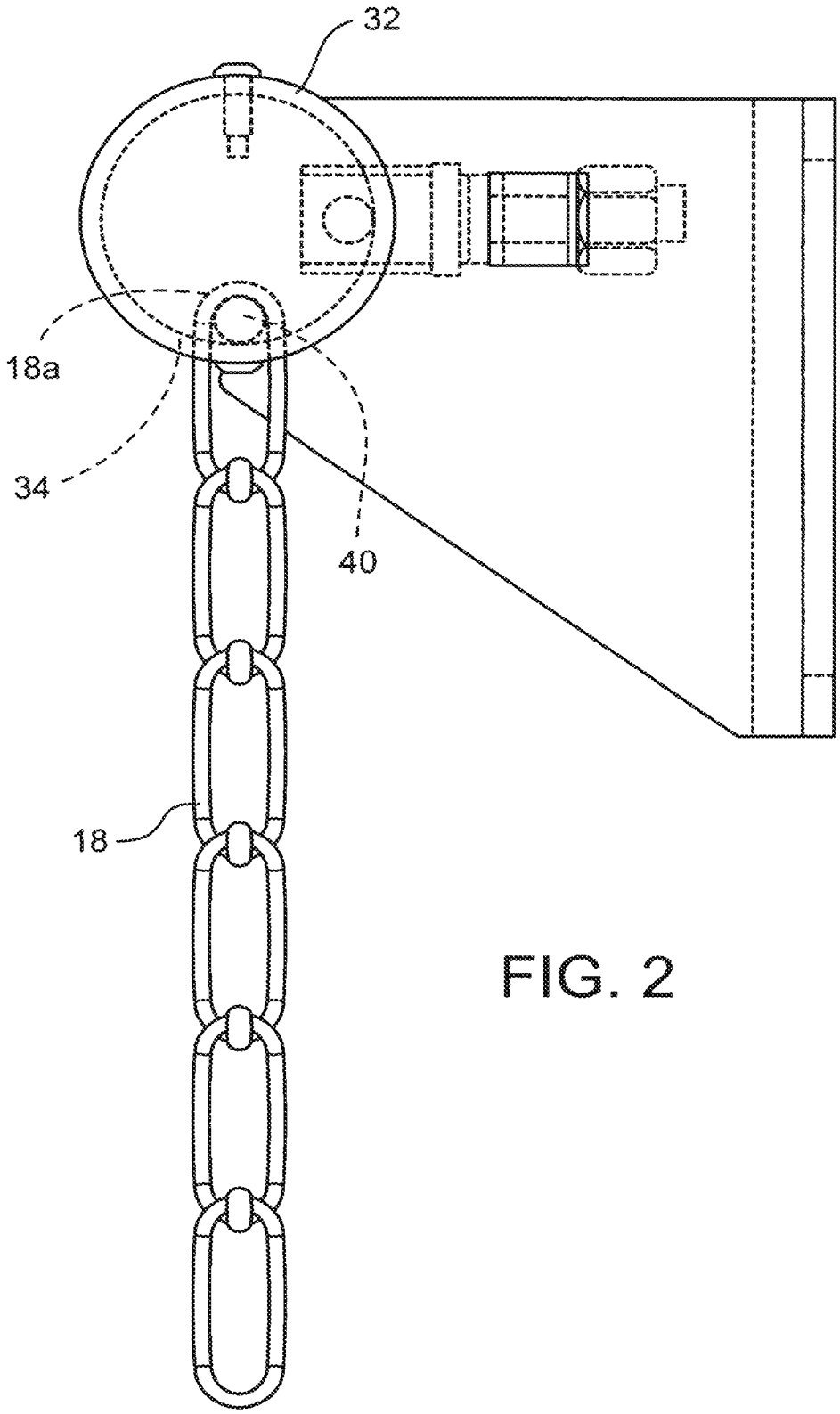
FIG. 2 is a side elevational view of the hanger bar assembly.
Figure 3:
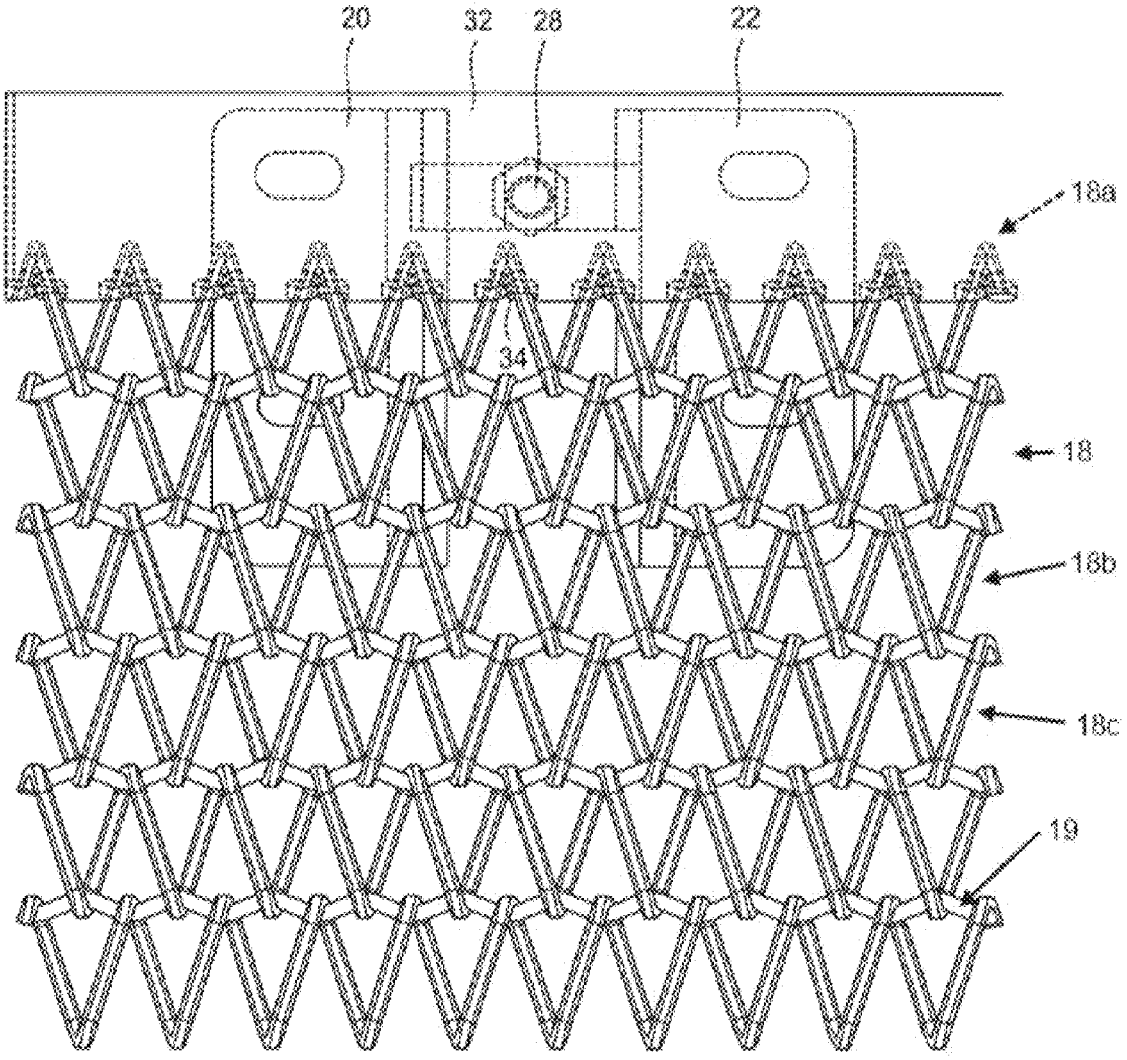
FIG. 3 is a partial front elevational view of the hanger bar assembly.

Referring also to FIGS. 2 and 3, the hangar bar assembly 10 is preferably disposed at an upper vertical edge of a section of architectural mesh 18 or a similar metal configuration. The architectural mesh 18 shown in FIGS. 1-5 is formed by a plurality of sets of substantially identical loops 18*b*, 18*c*. As shown in FIGS. 1 and 3, the architectural mesh 18 may be formed of a plurality of sets of loops where one set of loops may be formed to spiral in one direction 18*b* and another set of loops may be formed to spiral in another direction 18*c*. The sets of loops 18*b*, 18*c* are assembled in an alternating configuration. Each set of loops 18*b*, 18*c* is meshed with at least one other set of loops by a connecting rod 19. The hanger bar assembly 10 includes a left wall bracket 20 and a right wall bracket 22 preferably attached to a vertical support surface (not shown) disposed parallel to the desired hanging plane of the architectural mesh sunscreen 18. A hanger bracket support 26 is disposed between the left and right wall brackets 20, 22 and a fastener 28 extends therethrough to support a hanger tube 32, preferably a cylindrical tube, having a predetermined length suitable for the width of the architectural mesh panel 18.

Figure 4:
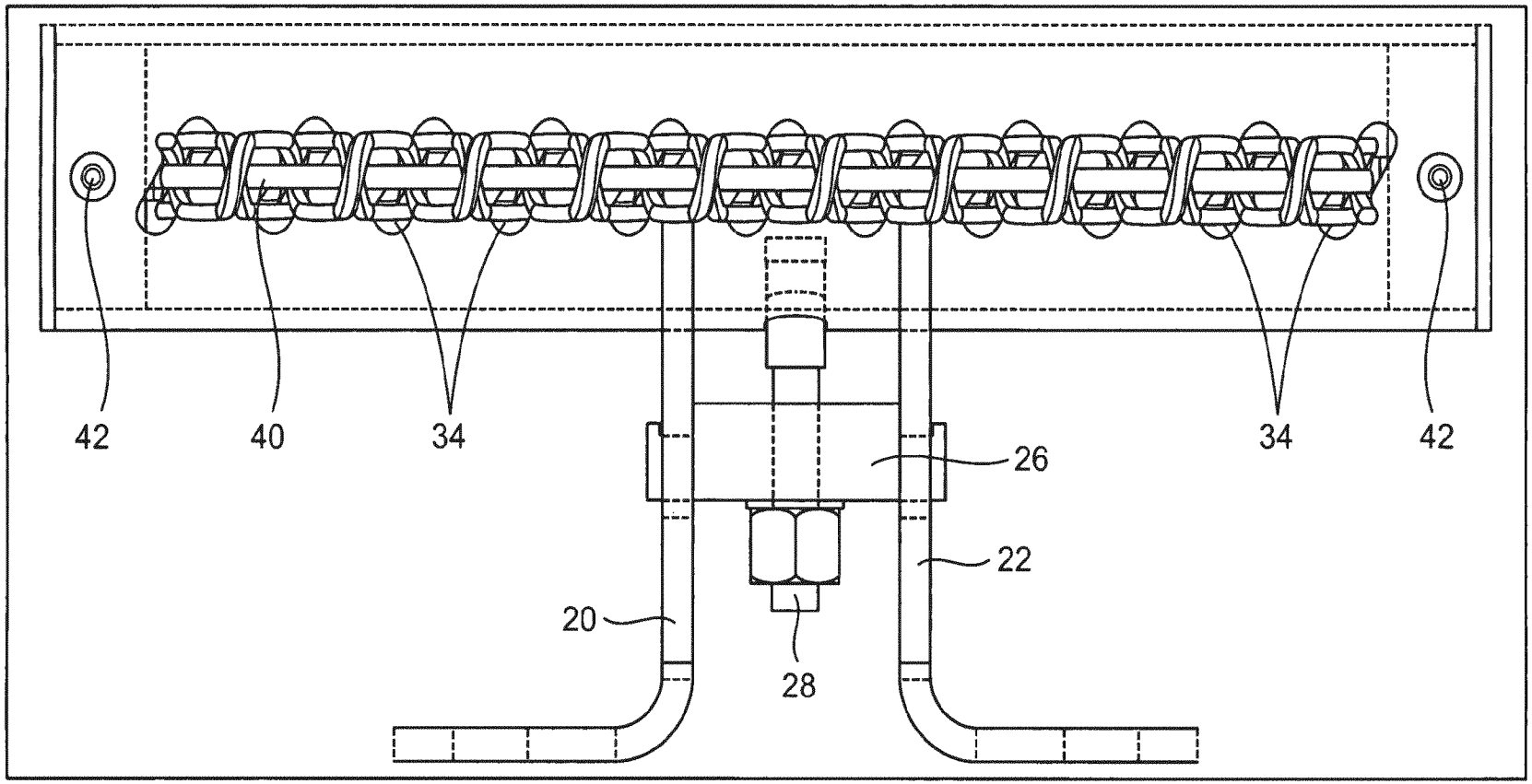
FIG. 4 bottom plan view of the hanger bar assembly.
Figure 5:
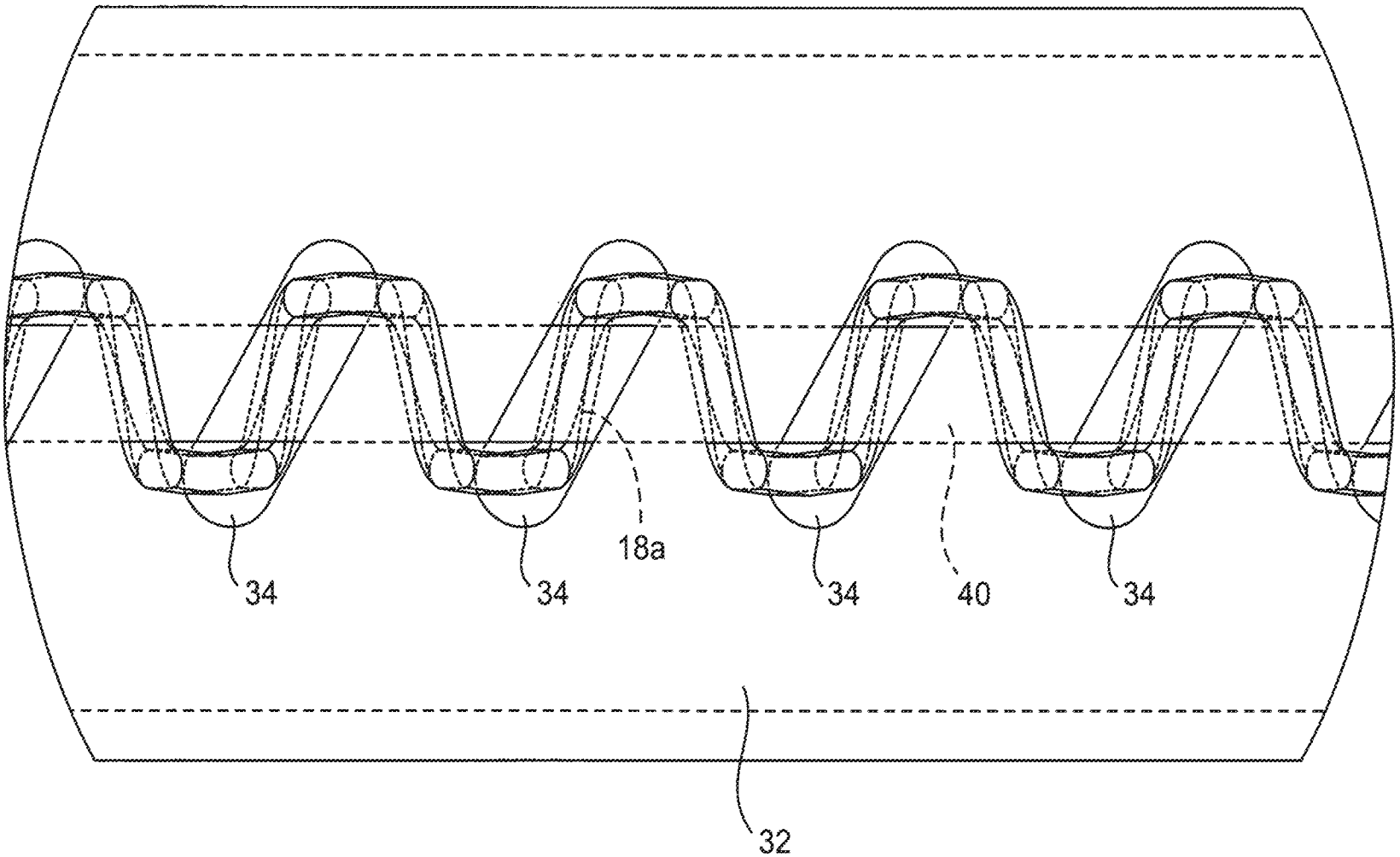
FIG. 5 is an enlarged partial bottom plan view of the hanger bar assembly.

In the preferred embodiment, the hanger tube 32 includes a plurality of slots 34 on the bottom surface thereof, as shown best in FIGS. 4 and 5. The mesh 18, and more particularly each of the uppermost set of loops 18*a* of the mesh 18, extends through a respective one of the slots 34 and into the interior of the hanger tube 32. Within the hanger tube, each of the uppermost loops of the uppermost set of loops 18*a* receives a retainer rod 40 extending the length of the hanger tube 32. Thus, the retainer rod 40 extends through the hanger tube 32 and engages the uppermost set of loops 18*a* of the mesh 18 forming the architectural panel. A retainer pin 42 disposed on each terminal end of the tube 32 further secures the rod 40 against horizontal movement. Moreover, because the uppermost loops of the mesh material and the retaining rod 40 are within the hanger tube 32, these supporting elements are substantially hidden from view when the architectural panel 18 is installed in the desired application; thus not detracting from the aesthetic appeal of the architectural panel 18.

While the present invention has been described with respect to a particular embodiment of the present invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the present invention.

The invention claimed is:

1. A hanger bar assembly for an architectural mesh comprising:

a hanger bar comprising a hollow hanger tube with a plurality of openings;

mounting means for mounting the hanger bar, the mounting means comprising at least one bracket attachable to a vertical support surface, the vertical support surface being disposed substantially parallel to a desired hanging plane of the architectural mesh, the at least one bracket of the mounting means being fixedly secured to the hanger bar; and the architectural mesh comprising a plurality of sets of substantially identical helical loops and connector rods, the plurality of sets of helical loops comprising alternating sets of loops, each set of helical loops being linked by a connector rod to at least one other set of helical loops, an uppermost one of the plurality of sets of helical loops having one end being inserted into the plurality of openings of the hollow hanger bar, the uppermost one of the plurality of sets of helical loops having an other end being connected to an adjacent one of the plurality of sets of helical loops.

2. The architectural mesh hanging system of claim 1, wherein the hollow hanger tube further comprises at least two retaining pins arranged on opposite ends of the hollow hanger tube, the retaining pins securing the retaining rod's lengthwise position within the hollow hanger tube.

3. The architectural mesh hanging system of claim 2, wherein the at least two retaining pins extend through the hollow hanger tube in a direction parallel to the desired hanging plane of the architectural mesh.

4. The architectural mesh hanging system of claim 1, wherein the uppermost one of the plurality of sets of helical loops is substantially identical to the adjacent one of the plurality of sets of helical loops connected thereto.

5. The architectural mesh hanging system of claim 1, wherein the uppermost one of the plurality of sets of helical loops is identical to another one of the plurality of sets of helical loops.

6. An architectural mesh hanging system comprising:

a hanger assembly comprising a hollow hanger tube with at least one opening arranged along a lengthwise surface, the hollow hanger tube being open at each terminal end;

mounting means for mounting the hanger assembly, the mounting means comprising at least one bracket attachable to a vertical support surface, the vertical support surface being disposed substantially parallel to a desired hanging plane of the architectural mesh, the at least one bracket of the mounting means being fixedly secured to the hanger assembly;

a continuous architectural mesh panel comprising a plurality of sets of substantially identical helical loops and a plurality of connector rods, the plurality of sets of helical loops comprising alternating sets of loops, each set of helical loops being intermeshed with at least one other set of helical loops, each connector rod being inserted through at least two adjacent sets of helical loops;

wherein the continuous architectural mesh panel with the plurality of sets of helical loops includes an uppermost set of helical loops, the uppermost set of helical loops being secured to an adjacent set of helical loops at one end by one of the plurality of connector rods, the uppermost set of helical loops having an other end configured for insertion through the at least one opening of the hollow hanger tube, the other end of the uppermost set of helical loops being retained in a position relative to the hollow hanger tube by a retaining rod adapted for insertion through the uppermost set of helical loops and the hollow hanger tube.

7. The architectural mesh hanging system of claim 6, wherein the plurality of connector rods are parallel to a lengthwise axis of the hollow hanger tube and a lengthwise axis of the retaining rod.

8. The architectural mesh hanging system of claim 6, wherein the mounting means further comprises a bracket support arranged between the first and second brackets, the bracket support having a fastener adapted to extend through the bracket support and into the hollow hanger tube and fixedly secure the hollow hanger tube.

9. The architectural mesh hanging system of claim 6, wherein the hollow hanger tube further comprises at least two retaining pins arranged on opposite ends of the hollow hanger tube, the retaining pins securing a lengthwise position of the retaining rod within the hollow hanger tube.

10. The architectural mesh hanging system of claim 9, wherein the at least two retaining pins extend through the hollow hanger tube in a direction parallel to the desired hanging plane of the architectural mesh.

11. The architectural mesh hanging system of claim 6, wherein the uppermost one of the plurality of sets of helical loops is substantially identical to the adjacent one of the plurality of sets of helical loops connected thereto.

12. The architectural mesh hanging system of claim 6, wherein the uppermost one of the plurality of sets of helical loops is identical to another one of the plurality of sets of helical loops.

13. A hanger bar assembly for an architectural mesh comprising:

a hanger bar comprising a hollow hanger tube with a plurality of openings;

mounting means for mounting the hanger bar, the mounting means comprising at least one bracket attachable to a vertical support surface, the vertical support surface being disposed substantially parallel to a desired hanging plane of the architectural mesh, the at least one bracket of the mounting means being fixedly secured to the hanger bar; and the architectural mesh comprising a plurality of sets of substantially identical links and connector rods, each set of links being linked by a connector rod to at least one other set of links, an uppermost one of the plurality of sets of links having one end being inserted into the plurality of openings of the hollow hanger bar, the uppermost one of the plurality of sets of links having an other end being connected to an adjacent one of the plurality of sets of links.

14. The architectural mesh hanging system of claim 13, wherein the hollow hanger tube further comprises at least two retaining pins arranged on opposite ends of the hollow hanger tube, the retaining pins securing the retaining rod's lengthwise position within the hollow hanger tube.

15. The architectural mesh hanging system of claim 14, wherein the at least two retaining pins extend through the hollow hanger tube in a direction parallel to the desired hanging plane of the architectural mesh.

16. The architectural mesh hanging system of claim 13, wherein the uppermost one of the plurality of sets of links is substantially identical to the adjacent one of the plurality of sets of links connected thereto.

17. The architectural mesh hanging system of claim 13, wherein the uppermost one of the plurality of sets of links is identical to another one of the plurality of sets of links.

* * * * *